United States Patent [19]

Yamaguchi et al.

[11] 4,066,421

[45] Jan. 3, 1978

[54] PROCESS FOR PRODUCING HIGH CALORIFIC VALUE FUEL GAS

[75] Inventors: Kaichiro Yamaguchi, Nishinomiya; Susumu Iguchi, Sakai, both of Japan

[73] Assignee: Osaka Gas Co. Ltd., Osaka, Japan

[21] Appl. No.: 787,311

[22] Filed: Apr. 14, 1977

Related U.S. Application Data

[63] Continuation of Ser. No. 605,429, Aug. 18, 1975, abandoned, which is a continuation-in-part of Ser. No. 254,647, May 18, 1972, abandoned.

[30] Foreign Application Priority Data

May 28, 1971 Japan ..... 46-37238

[51] Int. Cl.[2] ..... C10G 13/04; C10G 13/30

[52] U.S. Cl. ..... 48/213; 252/465; 252/470

[58] Field of Search ..... 48/197 R, 213; 252/455 R, 458, 465, 467, 470; 260/683.9

[56] References Cited

U.S. PATENT DOCUMENTS

| | | | |
|---|---|---|---|
| 3,280,207 | 10/1966 | Liquori | 252/470 |
| 3,421,870 | 1/1969 | Sinfelt et al. | 48/213 |
| 3,531,267 | 9/1970 | Gould | 48/213 |
| 3,849,087 | 11/1974 | Arkawa et al. | 48/213 |

FOREIGN PATENT DOCUMENTS

| | | | |
|---|---|---|---|
| 1,324,222 | 3/1963 | France | 260/683.9 |

*Primary Examiner*—S. Leon Bashore
*Assistant Examiner*—Peter F. Kratz
*Attorney, Agent, or Firm*—Larson, Taylor and Hinds

[57] ABSTRACT

A process for producing high calorific value fuel gas by catalytically hydrocracking a hydrocarbon is characterized in that the catalyst used comprises 10 to 70 weight percent of molybdenum oxide and 3 to 15 weight percent of at least one of nickel oxide, cobalt oxide and chromium oxide respectively supported on a solid carrier, the proportion of the latter metal oxide to the former metal oxide being in the range of 9 to 60 weight percent.

9 Claims, No Drawings

PROCESS FOR PRODUCING HIGH CALORIFIC VALUE FUEL GAS

This is a continuation, of application Ser. No. 605,429 filed Aug. 18, 1975 which in turn is a CIP of U.S. Ser. No. 254,647 filed May 18, 1972 both now abandoned.

The present invention relates to production of a high calorific value fuel gas useful for town gas, more particularly to a process for producing high calorific value fuel gas by catalytic hydrocracking of hydrocarbons.

With a fuel gas such as town gas which is transported over a long distance through a pipe, it is desired that the fuel gas be capable of producing the greatest possible amount of heat for advantageous use of the pipe network. Particularly, in recent years it is much required to use so called synthetic natural gas, i.e., fuel gas synthetically obtained and having such a high order of calorific value as interchangeable with natural gas. With a fuel gas containing methane as a main fuel component calorific value thereof is insufficient for the demand, since pure methane has a relatively low calorific value of about 9,500 Kcal/Nm$^3$. On the other hand, high calorific value fuel gases such as propane and butane can not be used for town gas to be transported through the pipe under pressure, since such gas will undergo partial condensation. Accordingly, it is desired that fuel gas contain, as a main fuel component, methane in combination with ethane which is non-condensable and has a higher calorific value than the former. However, it is difficult to obtain such high calorific value fuel gas by conventional methods without complicated procedures, and at present, no process has been developed for fulfilling this demand.

It is already known to convert hydrocarbons having not less than 3 carbon atoms, such as liquefied petroleum gas, naphtha, etc. to a fuel gas by thermal cracking, steam reforming, hydrocracking or like processes. According to thermal cracking and steam reforming processes, however, it is impossible to obtain a high calorific value fuel gas since the starting hydrocarbons are selectively converted into methane substantially free from the production of ethane.

Known processes for catalytically hydrocracking hydrocarbons to obtain gaseous products are generally classified into two types, one being those chiefly intended to obtain gasoline and/or LPG as disclosed in U.S. Pat. No. 3,531,267. The patent refers to catalysts comprising oxides, sulfides of Groups VI and VIII metals supported by a strongly acidic carrier such as silicalumina or a weakly acidic carrier such as alumina. However, because the process does not contemplate the production of methane, ethane and like low-molecular-weight hydrocarbon gases, there arises the necessity of further subjecting the resulting gasoline and/or LPG to another process such as steam reforming, if it is desired to achieve higher yields of the low-molecularweight gases. The product is therefore very costly. Although attempts have been made to practice the catalytic hydrocracking process alone under severe conditions of high temperature and high pressure to directly obtain methane and ethane in increased yields, namely to attain higher conversion of hydrocarbons to these gases, the operation involves the serious objection of readily permitting the deposition of carbonaceous substances which reduce the catalytic activity.

The other type of catalytic hydrocracking processes are those which employ a highly active catalyst such as nickel as disclosed for example in U.S. Pat. No. 3,421,870. However, this process converts hydrocarbons almost wholly to methane and gives only a small amount of ethane, thus failing to yield a high calorific value fuel gas. Moreover, use of excess hydrogen required to keep the catalyst active allows part of the hydrogen to remain unreacted to lower the calorific value of the gas obtained, making it impossible to yield a gas having the desired high calorific value.

An object of the invention is accordingly to provide a fuel gas, particularly useful as town gas, containing methane and ethane as a main fuel component and having a calorific value as high as more than 9,500 Kcal/Nm$^3$ interchangeable with natural gas.

Another object of the present invention is to provide the above high calorific value fuel gas in which the amount of propane and/or butane to be contained in combination with methane and ethane is reduced to a marked extent, so that the fuel gas can be effectively supplied as town gas as it is or after it has been mixed with diluting gas or with other fuel gases without undesired condensation during transportation thereof.

Another object of the invention is to provide a process for producing the above high calorific value fuel gas from hydrocarbons by catalytic hydrocracking with simple procedures, i.e., without employing additional steps of steam reforming, etc.

Another object of the invention is to provide a process for producing the above high calorific value fuel gas from hydrocarbons by catalytic hydrocracking in which hydrogen gas can be used in a relatively small amount as compared with that in the conventional catalytic hydrocracking method and which makes it possible to obtain a fuel gas containing a small amount of hydrogen and having high order of calorific value without a separation step of hydrogen.

These and other objects and advantages of the invention will be apparent from the description to follow.

In producing fuel gas by contacting a hydrocarbon having at least 3 carbon atoms and a boiling point of not more than 150° C with hydrogen in gaseous phase in the presence of a catalyst at a temperature of 150° to 400° C, a process for producing high calorific value fuel gas is characterized in that said catalyst comprises molybdenum oxide and at least one of nickel oxide, cobalt oxide and chromium oxide, respectively supported on a solid carrier in an amount of 10 to 70 weight percent and in an amount of 3 to 15 weight percent, based on the weight of the solid carrier respectively, the latter metal oxide being in a proportion of 9 to 60 weight percent, based on the weight of the molybdenum oxide.

According to the researches of the prosent inventors it has been found that when catalytic hydrocracking of hydrocarbons is conducted in the presence of the above specific catalyst ethane is selectively produced in combination with methane, whereby fuel gas having a high calorific value more than 9,500 Kcal/Nm$^3$ can easily be obtained. Our researches have revealed that among the numerous metal oxides and sulfides disclosed in U.S. Pat. No. 3,531,267, the combination of molybdenum oxide and at least one of nickel oxide, cobalt oxide and chromium oxide is especially excellent as a catalyst for the hydrocracking of hydrocarbons, when the oxides are used in specified weight proportions as supported by a carrier. More specifically, we have found that with the use of the catalyst high yields of methane and ethane can be easily obtained from hydrocarbons without employing severe operation conditions which will reduce the catalytic activity due to the deposition of carbonaceous substances. The amount of propane and/or butane to be contained in the resultant fuel gas is reduced to a marked extent, and therefore the fuel gas can be free from undesired condensation during transportation thereof when used as a town gas as it is or after it has been mixed with diluting gas or with other fuel gases. According to the present invention, moreover, the reaction can be conducted at a low temperature of 150° to 400° C using a far smaller amount of hydrogen gas than in the conventional hydrocracking method, so that the procedure and apparatus can be simplified. Further, since the amount of hydrogen used is reduced and the amount of ethane produced is increased, a high calorific value fuel gas can be obtained without resorting to any step to separate hydrogen.

In the invention the starting hydrocarbons are those having at least 3 carbon atoms and a boiling point of not more than 150° C. Such hydrocarbons include, saturated aliphatic hydrocarbons, saturated alicyclic hydrocarbons and aromatic hydrocarbons. Examples of the hydrocarbons are propane, butane, hexane, cyclohexane, benzene, toluene, mixtures thereof, liquid petroleum gas, petroleum naphtha, etc. These hydrocarbons can be used singly or in admixture with one another. Although unsaturated aliphatic hydrocarbons may be used, they are not very preferable in the invention since hydrogen used in the present reaction will be consumed for saturation thereof and conversion will be lowered. Therefore it is preferable in the invention to use at least one of saturated aliphatic hydrocarbons, saturated alicyclic hydrocarbons and aromatic hydrocarbons containing or not containing unsaturated aliphatic hydrocarbons in an amount of less than 20 weight percent, preferably less than 5 weight percent. Particularly preferable hydrocarbons are saturated aliphatic hydrocarbons having 3 to 9 carbon atoms. Hydrocarbons having a boiling point of more than 150° C can not be used since the use thereof results in production of carbonaceous substance, reducing yield of the fuel gas and lowering activity of the catalyst used.

It is essential in the invention to subject the hydrocarbons to hydrocracking in the presence of the specific catalyst disclosed before. The catalyst used in the invention comprises molybdenum oxide and at least one of nickel oxide, cobalt oxide and chromium oxide, respectively supported on a solid carrier. Preferable catalysts are those comprising (a) molybdenum oxide and nickel oxide, (b) molybdenum oxide, nickel oxide and cobalt oxide, and (c) molybdenum oxide, nickel oxide and chromium oxide. Most preferable is a catalyst comprising molybdenum oxide and nickel oxide. The amount of molybdenum oxide supported on the carrier is in the range of 10 to 70 weight percent, based on the weight of the solid carrier. When the amount of molybdenum oxide is less than 10 weight percent the catalytic activity is lowered and the reaction can not proceed effectively, while the amount more than 70 weight percent will not produce improved results. Thus preferable amount of molybdenum oxide is in the range of 14 to 32 weight percent, based on the weight of the solid carrier. The amount of at least one of nickel oxide, cobalt oxide and chromium oxide supported on the solid carrier is in the range of 3 to 15 weight percent, based on the weight of the solid carrier. When the amount of the above metal oxide is lower than 3 weight percent, the catalytic activity will be lowered, whereas an increased amount thereof larger than 15 weight percent results in increase of the production of methane with decrease of that of ethane. Preferable amount of such metal oxide is in the range of 4 to 10 weight percent, based on the weight of the solid carrier. The proportions of molybdenum oxide and at least one of nickel oxide, cobalt oxide and chromium oxide closely relate to the selective formation of ethane. It is essential to use the latter metal oxide in the range of 9 to 60 weight percent, based on the weight of the molybdenum oxide. If the proportion is less than 9 weight persent, a lower catalytic activity will result, whereas if it is higher than 60 weight percent, the selective formation of ethane will reduce. Most preferably, the proportion is in the range of 15 to 30 weight percent.

The solid carrier on which the above metal oxides are supported must be nonreactive under the reaction conditions and, from the viewpoint of the ability of the catalyst to permit selective formation of ethane as well as of catalytic activity, preferably has a surface area of 60 to 400 $m^2$ per gram of the catalyst. γ-Alumina and silica are advantageously used in this invention. γ-Alumina is more preferable in imparting to the catalyst a greater ability to selectively yield ethane and in maintaining the catalytic activity for a prolonged period of time. However, silica is usable singly or in admixture with γ-alumina.

The selective formation of ethane and catalytic activity also depend in some degree on the method by which the catalyst is prepared. It is preferable to prepare the catalyst of this invention by impregnation method or wet mixing method. With a catalyst comprising equal amounts of metal oxides of the same kind, the catalyst exhibits the same properties at the initial stage of reaction, regardless of whether it is prepared by impregnation method or wet mixing method, but impregnation method is advantageous in ensuring a sustained catalytic activity. The preparation of catalysts is practiced following the same procedure as in the preparation of conventional metal oxide catalysts. For example, according to the impregnation method, catalysts are prepared in the following manner. In an aqueous solution having dissolved therein a water-soluble molybdenum compound and at least one of water-soluble compounds of chromium, nickel and cobalt is immersed a solid carrier in the form of pellets. The solid carrier is then baked in air to oxidize the metal compounds into metal oxides. Baking or firing is usually conducted at about 400° to 600° C for about 3 to 6 hours, though these conditions are variable with the kinds of metal compounds used, amounts of metal oxides to be supported on the carrier, etc. Alternatively alumina gel and/or silica gel is added to an aqueous solution having dissolved therein a water-soluble molybdenum compound and at least one of water-soluble compounds of chromium, nickel and cobalt. The mixture is then concentrated by evaporation of water, and molded into pellets having a desired form. The pellets thus obtained are fired in air to obtain a metal oxide catalyst of this invention. Firing conditions in this wet mixing method are substantially similar to those in the impregnation method. Various water-soluble metal compounds can be used in the preparation of catalysts. Examples of water-soluble molybdenum compounds are $(NH_4)_6Mo_7O_{24}\cdot 4H_2O$ (ammonium paramolybdate), $(NH_4)_2MoO_4$, etc. Examples of water-soluble compounds of nickel, cobalt and chromium are $Ni(NO_3)_2\cdot 6H_2O$, $NiSO_4\cdot 6H_2O$, $Ni(OH)_2$, etc., $Co(NO_3)_2\cdot 6H_2O$, $CoCO_3$, etc., and $CrO_3$, $Cr(NO_3)_3\cdot 9H_2O$, $(NH_4)_2CrO_4$, etc. The catalyst is usable in any of various forms such for example as pellet, tablet, sphere, cylinder, rod, etc.

According to the present invention the starting hydrocarbons are brought into contact with hydrogen in the presence of the above specific catalyst at an elevated temperature to produce high calorific value fuel gas. The reaction temperature is in the range of 150° to 400° C. When the temperature is less than 150° C the reaction velocity is reduced, whereas a temperature more than 400° C results in undesired deposition of carbonaceous substance, reducing catalytic activity markedly. Preferable reaction temperature is in the range of 200° to 350° C. The reaction pressure is not critical and the reaction can be usually carried out at atmospheric pressure, but increased pressure of less than 50 kg/cm², preferably less than 20 kg/cm², is also applicable in the invention.

The amount of hydrogen to be used in this invention is far smaller than that of the conventional methods, though it varies depending upon the reaction conditions and calorific value of the fuel gas to be obtained. In the conventional hydrocracking methods it has been necessary to use hydrogen in such as excessive amount as more than 5 : 1 in terms of ratio of hydrogen atom to carbon atom contained in the starting mixture of hydrogen and hydrocarbons in order to proceed the reaction effectively. However, the amount of hydrogen used in the invention can be reduced to a range between 3.5 : 1 and 4.0 : 1, preferably between 3.5 : 1 and 3.7 : 1, in terms of a ratio of hydrogen atom and carbon atom contained in the starting mixture.

Although a decomposition gas predominantly comprising methane and ethane will be also produced with the use of an amount of hydrogen in excess of the above range, the use of a large volume of hydrogen will permit the end product to contain excess hydrogen to lower the calorific value thereof and is therefore undesirable. In this way hydrocracking reaction can be effected at a low hydrogen concentration with a high conversion of the starting hydrocarbons and without giving rise to deposition of carbonaceous substance. Thus there is no need to separate unreacted hydrogen in additional steps. This is one of the features of this invention. The hydrogen to be used in this invention may be pure hydrogen, but a hydrogen-containing gas is also employable. Particularly with the present invention, it is most preferable to use a mixture of hydrogen and methane, because if methane is conjointly present, the amount of ethane produced by hydrocracking of hydrocarbons along with methane will be greater than when only hydrogen is used. As the gas mixture of hydrogen and methane, it is preferable to use a gas prepared by removing carbon dioxide from a gas ( a mixture of $H_2$, $CH_4$, CO and $CO_2$) produced by steam reforming of a petroleum fraction. Such gas usually contains up to 75 mole % of methane and is applicable as hydrogen source to the method of the invention after carbon dioxide is removed therefrom. Hydrogen can also be used in a form of a mixture with nitrogen or like inert gas.

The fuel gas obtained in accordance with the present invention contains methane and ethane as a main fuel component and can be used as it is or after it has been mixed with diluting gas or with other fuel gases, as required.

This invention will be described in greater detail with reference to examples given below. All the parts used in the examples are by weight unless otherwise specified.

EXAMPLE 1

Thirty milliliters of a cylindrical catalyst, 3 mm in diameter and 3 mm in length, prepared by impregnation method and comprising 17 parts of molybdenum oxide, 4.0 parts of nickel oxide and 1.0 part of chromium oxide supported on 100 parts of alumina carrier was packed in a reactor tube measuring 1 inch in diameter. The catalyst had a surface area of about 120 m²/g. A mixture of n-butane and hydrogen gases was diluted to 50 mole % with a given diluting gas and passed through the catalyst layer under predetermined reaction conditions. The results are given in Table 1.

| | |
|---|---|
| Pressure: | 1 kg/cm² |
| $H_2/C_4H_{10}$ (molar ratio): | 2.0 |
| Flow rate: | 120 1/hr (calculated as in standard state) |
| SV: | 4,000 cc/hr/cc |

Table 1

| Run No. | | I | II | III |
|---|---|---|---|---|
| Reaction temperature (° C) | | 295 | 305 | 305 |
| Diluting Gas | | $N_2$ | $N_2$ | $CH_4$ |
| Conversion of n-$C_4H_{10}$(%) | | 70.3 | 81.8 | 81.5 |
| Components of gas produced (mole %) | $H_2$ | 29.1 | 20.7 | 25.8 |
| | $CH_4$ | 36.5 | 49.5 | 42.6 |
| | $C_2H_6$ | 7.81 | 9.59 | 9.88 |
| | $C_3H_8$ | 14.0 | 13.5 | 15.2 |
| | $C_4H_{10}$ | 9.90 | 6.07 | 6.11 |
| $CH_4/C_2H_6$ ratio (mole) | | 4.68 | 5.16 | 4.31 |
| $CH_4/C_3H_8$ ratio (mole) | | 2.60 | 3.66 | 2.80 |

In the case where $CH_4$ was used as diluent, the $CH_4/C_2H_6$ ratio and $CH_4/C_3H_8$ ratio in Table 1 above were calculated exclusive of $CH_4$ used for dilution. The components of gas produced show the analytic results of the gas obtained after 3 hours' reaction. These results were found substantially the same as those of the gas obtained after 24 hours' continuous reaction.

COMPARISON EXAMPLE 1

The reaction was conducted in the same manner as in Run No. II of Example 1 except that nickel oxide catalyst (trade name "G-65" of Nissan Chemetron Catalyst Ltd., Japan, cylindrical catalyst, 6.3 mm in diameter and 6.3 mm in length, containing 25 weight percent of nickel supported in the form of Ni and NiO on a solid carrier) was used for comparison. In this Comparison Example molar ratio of hydrogen to n-butane was varied as shown in Table 2 below. The results are shown in Table 2.

Table 2

| Run No. | | IV | V | VI |
|---|---|---|---|---|
| $H_2/C_4H_{10}$ (molar ratio) | | 2.0 | 3.0 | 6.0 |
| Conversion of n-$C_4H_{10}$ (%) | | 64.5 | 80.7 | 78.5 |
| Components of gas produced (mole %) | $H_2$ | 6.2 | 15.4 | 52.8 |
| | $CH_4$ | 80.2 | 79.5 | 43.7 |
| | $C_2H_6$ | 0.7 | Trace | 0.1 |
| | $C_3H_8$ | 1.2 | 0.4 | 0.3 |
| | $C_4H_{10}$ | 11.3 | 4.8 | 3.1 |

In Run Nos. V and VI gas obtained after 3 hours' reaction was analyzed for finding components of gas, but in Run No. IV gas obtained after 5 minutes' reaction was analyzed therefor since continuous reaction more than 5 minutes results in marked decrease of conversion of n-butane due to deposition of carbonaceous substance.

EXAMPLE 2

A gas mixture of liquefied petroleum gas containing the following components with hydrogen was preheated to a temperature corresponding a reaction temperature and was thereafter passed through the same catalyst layer as in Example 1 under the conditions shown in Table 3. The results are listed in Table 3.

The liquefied petroleum gas used was analyzed by gas chromatography with the following results:

| Composition of LPG (mole %) | |
|---|---|
| n-Butane: | 63.97 |
| Iso-butane: | 32.59 |
| Propane: | 3.13 |
| Propylene: | 0.10 |
| Ethane: | 0.21 |

Table 3

| Run No. | | VII | VIII |
|---|---|---|---|
| Reaction pressure (kg/cm²) | | 1.0 | 5.0 |
| Reaction temperature (° C) | | 335 | 330 |
| Space velocity (cc/hr/cc) | | 2000 | 2000 |
| $H_2$/LPG (mole/mole) | | 3.0 | 2.0 |
| Conversion of n-butane (%) | | 89.2 | 92.5 |
| Components of gas produced (mole %) | $H_2$ | 29.54 | 2.18 |
| | $CH_4$ | 52.06 | 75.28 |
| | $C_2H_6$ | 9.86 | 13.75 |
| | $C_3H_8$ | 5.27 | 5.80 |
| | i-$C_4H_{10}$ | 1.52 | 1.40 |
| | n-$C_4H_{10}$ | 1.75 | 1.59 |
| $CH_4/C_2H_6$(molar ratio) | | 5.28 | 5.47 |
| Calorific value (Kcal/Nm³) | | 9850 | 11920 |

COMPARISON EXAMPLE 2

Under the following conditions, reaction was conducted in the similar manner as in Example 2 except that the catalyst used supported tungsten oxide in place of molybdenum oxide. The results are given in Table 4 below.

Table 4

| Run No. | | IX | X |
|---|---|---|---|
| Reaction pressure (kg/cm²) | | 1.0 | 1.0 |
| Reaction temperature (° C) | | 400 | 500 |
| Space velocity (cc/hr/cc) | | 2000 | 2000 |
| $H_2$/LPG (mole/mole) | | 3.0 | 3.0 |
| Conversion to n-butane (%) | | 3.6 | 4.7 |
| Components of gas produced (mole %) | $H_2$ | 75.61 | 75.43 |
| | $CH_4$ | 0.22 | 0.55 |
| | $C_2H_6$ | 0.11 | 0.21 |
| | $C_3H_8$ | 0.71 | 0.75 |
| | i-$C_4H_{10}$ | 7.94 | 7.82 |
| | n-$C_4H_{10}$ | 15.42 | 15.24 |

EXAMPLE 3

The catalyst, 3 mm in diameter and 3 mm in length, prepared by impregnation method and comprising 30 parts of molybdenum oxide, 5.0 parts of nickel oxide and 1.0 part of chromium oxide supported on 100 parts of alumina carrier was used in this Example. A gas mixture consisting of naphtha having the characteristics shown in Table 5 below and hydrogen was preheated at a temperature corresponding to a reaction temperature and then passed through a catalyst bed made up to 60 cc of the catalyst under the reaction conditions shown in Table 6.

The results are also given in Table 6 below.

Table 5

| | | |
|---|---|---|
| Specific gravity (15/4° C) | | 0.6817 |
| Fractionating test | Initial boiling point | 35.5° C |
| | 10 % | 51.8° C |
| | 50 % | 72.0° C |
| | 90% | 100.0° C |
| | Final boiling point | 125.2° C |
| | Amount of residue | 0.5 ml |
| | Oil loss | 2.3 ml |

Table 6

| Run No. | | XI | XII |
|---|---|---|---|
| Reaction temperature (° C) | | 350 | 380 |
| Reaction pressure (kg/cm²) | | 10.0 | 20.0 |
| $H_2$/Oil (m³/liter) | | 0.757 | 0.838 |
| H/C (atomic ratio) | | 3.60 | 3.75 |
| Space velocity (LHSV) | | 2.0 | 2.0 |
| Rate of gasification (%) | | 95.0 | 97.5 |
| Components of gas produced (mole %) | $H_2$ | 7.61 | 14.18 |
| | $CH_4$ | 72.16 | 65.34 |
| | $C_2H_6$ | 13.59 | 12.64 |
| | $C_3H_8$ | 6.64 | 7.84 |
| | $C_4^+$ | — | — |
| Liquid product (g) | | 4.1 | 2.3 |
| $CH_4/C_2H_6$ (molar ratio) | | 5.31 | 5.17 |
| Calorific value (Kcal/Nm³) | | 11000 | 10690 |

The rate of gasification above was calculated per carbon atom of the starting hydrocarbons and the amount of the liquid product was calculated per 100 g of the starting hydrocarbons.

EXAMPLE 4

In the same manner as in Example 1 fuel gases were produced at 295° C from a mixture of n-butane and hydrogen except that the following catalyst comprising varying amounts of molybdenum oxide and nickel oxide supported on 100 parts of γ-alumina measuring 3 mm in diameter and 3 mm in length were employed respectively in place of the catalyst used in Example 1. The results are shown in Table 7.

Table 7

| Run No. | Metal oxides $MoO_3$ (%) | NiO (%) | $\frac{NiO}{MoO_3} \times 100$ (%) | Conversion of n-$C_4H_{10}$ (%) | Production (mole %) $H_2$ | $CH_4$ | $C_2H_6$ | $C_3H_8$ | $C_4H_{10}$ | Formation of $C_2H_6$ (%) |
|---|---|---|---|---|---|---|---|---|---|---|
| XIII | 5.0 | 1.9 | 38.0 | 18.5 | 60.1 | 6.34 | 0.68 | 5.66 | 27.2 | — |
| XIV | 5.1 | 12.0 | 235 | 47.9 | 46.7 | 20.1 | 3.87 | 12.0 | 17.4 | — |
| XV | 5.0 | 28.0 | 560 | 71.2 | 15.0 | 65.1 | 0.93 | 9.31 | 9.60 | 2.0 |
| XVI | 13.9 | 2.0 | 14.4 | 29.9 | 53.6 | 13.1 | 3.11 | 6.84 | 23.4 | — |
| XVII | 40.0 | 2.1 | 5.25 | 40.3 | 48.5 | 18.2 | 4.80 | 8.63 | 19.9 | — |
| XVIII | 13.9 | 8.1 | 58.3 | 78.1 | 21.4 | 50.7 | 8.09 | 12.4 | 7.30 | 15.6 |
| XIX | 68.0 | 7.0 | 10.2 | 80.2 | 28.0 | 40.2 | 8.88 | 16.3 | 6.60 | 16.7 |
| XX | 51.0 | 12.0 | 23.5 | 79.4 | 26.9 | 42.3 | 8.80 | 15.2 | 6.90 | 16.7 |
| XXI | 14.0 | 28.0 | 200 | 78.6 | 16.4 | 61.2 | 2.15 | 13.1 | 7.13 | 4.1 |
| XXII | 39.8 | 27.9 | 70.1 | 78.5 | 17.7 | 58.4 | 4.08 | 12.7 | 7.17 | 7.8 |
| XXIII | 18.0 | 12.0 | 66.7 | 70.5 | 21.4 | 54.1 | 4.32 | 10.4 | 9.83 | 9.2 |

Table 7-continued

| Run No. | Metal oxides $MoO_3$ (%) | NiO (%) | $\frac{NiO}{MoO_3} \times 100$ (%) | Conversion of n-$C_4H_{10}$ (%) | Production (mole %) $H_2$ | $CH_4$ | $C_2H_6$ | $C_3H_8$ | $C_4H_{10}$ | Formation of $C_2H_6$ (%) |
|---|---|---|---|---|---|---|---|---|---|---|
| XXIV | 50.0 | 4.1 | 8.2 | 63.5 | 26.4 | 47.2 | 5.24 | 8.95 | 12.2 | 12.4 |

From the results given in Table 7, the following can be concluded.

a. In the case the $MoO_3$-content is maintained at a value of about 5 wt.% (catalysts No. XIII, XIV and XV), the increase in the NiO-content enhances the activity of catalyst with the result that conversion of n-$O_4H_{10}$ is gradually heightened. However, the formation of $C_2H_6$ is hindered so long as the $MoO_3$-content is maintained at this value.

b. In the case the $MoO_3$-content is maintained at a value of about 14 wt.% (catalysts No. XVI, XVIII and XXI), the increase in NiO-content gives rise to high conversion of n-$C_4H_{10}$ and high formation of $C_2H_6$. However, excessively high content of NiO contrariwise lowers the formation of $C_2H_6$.

c. In the case of NiO-content is maintained at a value of about 2 wt.% (catalysts No. XIII, XVI and XVII), the activity of catalyst can not be satisfactorily improved even if the $MoO_3$-content is increased.

d. In the case the NiO-content is greatly increased to a value of about 28 wt.% (catalysts No. XV and XXI), the activity of catalyst is highly improved with the result of high conversion of n-$C_4H_{10}$, but the formation of $C_2H_6$ is not so high.

e. If the proportion of NiO to $MoO_3$ is not in the range of 9 to 60 weight percent, high conversion of n-$C_4H_{10}$ and selective formation of $C_2H_6$ cannot be achieved even if amounts of NiO and $MoO_3$ are in the specified ranges of 3 to 15 weight percent and 10 to 70 weight percent respectively based on the weight of solid carrier.

f. In conclusion, the catalyst must comprise $MoO_3$ and NiO respectively supported on a solid carrier in an amount of 10 to 70 wt.% and in an amount of 3 to 15 wt.%, respectively based on the weight of the solid carrier, in order to produce high conversion of n-$C_4H_{10}$ and high formation of $C_2H_6$.

EXAMPLE 5

In the same manner as in Example 1 fuel gas was prepared from n-butane under the conditions shown in Table 8 except that in place of hydrogen hydrogen-containing gas prepared by removing carbon dioxide from a gas produced by steam reforming of hydrocarbons was employed. The hydrogen-containing gas comprised:

| | Mole % |
|---|---|
| $H_2$ | 26.2 |
| CO | 1.26 |
| $CO_2$ | 2.94 |
| $CH_4$ | 69.6 |

Table 8

| Run No. | XXV | XXVI |
|---|---|---|
| $H_2$/n-$C_4H_{10}$ (molar ratio) | 1.7 | 2.0 |
| Reaction temperature (° C) | 300 | 320 |
| SV (cc/hr/cc) | 2000 | 2000 |
| Conversion of n-$C_4H_{10}$ (%) | 72.4 | 80.1 |

Table 8-continued

| Run No. | | XXV | XXVI |
|---|---|---|---|
| Components of gas produced (mole %) | $H_2$ | 2.0 | 2.1 |
| | CO | 0.5 | 0.4 |
| | $CO_2$ | 1.4 | 1.9 |
| | $CH_4$ | 83.0 | 84.6 |
| | $C_2H_6$ | 3.8 | 3.5 |
| | $C_3H_8$ | 5.4 | 4.9 |
| | $C_4H_{10}$ | 4.0 | 2.5 |
| Calorific value (Kcal/Nm³) | | 11220 | 10720 |

EXAMPLE 6

A catalyst comprising 14 parts of molybdenum oxide and 8 parts of nickel oxide supported on 100 parts of γ-alumina carrier was prepared by impregnation method. The same procedure is repeated except that silica and a mixture of 25% γ-alumina and 75% silica are used respectively to prepare two kinds of catalysts. Each of the carriers used is in the form of pellets 3 mm in diameter and 3 mm in length. Table 10 below shows the properties of the catalysts.

Table 9

| Catalyst | Solid carrier | Surface area (m²/g) | Volume of pores (cc/g) | Bulk density (g/cc) |
|---|---|---|---|---|
| C | γ-$Al_2O_3$ | 163 | 0.13 | 0.79 |
| D | $SiO_2$ | 350 | 0.51 | 0.80 |
| E | 25% γ-$Al_2O_3$ 75% $SiO_2$ | 230 | 0.60 | 0.60 |

Subsequently, under the same conditions as for Run No. I in Example 1, a high calorific value gas is produced as shown in Table 10, while adjusting the amount of the catalyst used so that the conversion of n-butane is 78%.

Table 10

| Run No. | XXVII | XXVIII | XXIX |
|---|---|---|---|
| Catalyst | | | |
| Kind | C | D | E |
| Amount (cc) | 30 | 25 | 55 |
| Reaction temperature (° C) | 295 | 295 | 295 |
| Conversion of n-$C_4H_{10}$ (%) | 78 | 78 | 78 |
| Components of gas produced (vol. %) | | | |
| $H_2$ | 21.4 | 11.5 | 15.3 |
| $CH_4$ | 50.7 | 67.4 | 61.2 |
| $C_2H_6$ | 8.09 | 4.52 | 5.67 |
| $C_3H_8$ | 12.40 | 9.20 | 10.50 |
| $C_4H_{10}$ | 7.30 | 7.38 | 7.33 |
| $C_2H_6$ yield (%) | 15.6 | 8.9 | 10.9 |
| Calorific value (Kcal/Nm³) | 12,200 | 12,100 | 12,150 |

Table 10 shows that the amount of catalyst required to achieve a definite conversion of butane, the starting material, is the smallest in case of the silica-supported catalyst, larger with the γ-alumina-supported catalyst, and the largest with the catalyst composed of 25% γ-alumine — 75% silica mixture carrier. On the other hand, the highest ethane yield is achieved by the alumina-supported catalyst, then a lower yield by the catalyst supported by the alumina-silica mixture and a still lower yield by the silica-supported catalyst. From the overall viewpoint in respect of the required amount of catalyst and ethane yield, γ-alumina-supported catalyst is most advantageous. However, the other catalysts are also fully useful in this invention since they enable the production of gases having high calorific values of at least 12,100 Kcal/Nm³.

EXAMPLE 7

Reaction is conducted under the same conditions as in Example 1 using Catalyst C of Example 6. The results are shown in Table 11, which also gives like results achieved in Example 8.

With the lapse of the reaction time, the catalytic activity reduces, lowering the conversion of butane. The elevation of the reaction temperature required to maintain the initial conversion at the outset of the reaction is determined 50 hours and 500 hours after the initiation of the reaction. Table 12 shows the results along with like results obtained in Example 8.

EXAMPLE 8

A catalyst, 3 mm in diameter and 3 mm in length, comprising 14 parts of molybdenum oxide and 8 parts of nickel oxide supported on 100 parts of γ-alumina is prepared by wet mixing method.

Table 11

| | Example 7 | Example 8 |
|---|---|---|
| Composition of gas produced upon initiation of reaction (vol. %) | | |
| $H_2$ | 21.40 | 25.70 |
| $CH_4$ | 50.70 | 45.30 |
| $C_2H_6$ | 8.09 | 7.44 |
| $C_3H_8$ | 12.40 | 12.90 |
| $C_4H_{10}$ | 7.30 | 8.60 |
| Formation of $C_2H_6$ (%) | 15.6 | 14.3 |
| Conversion of $C_4H_{10}$(%) | | |
| Upon initiation of reaction | 78.1 | 74.2 |
| 50 hours thereafter | 73.8 | 65.1 |
| 500 hours thereafter | 63.7 | 41.7 |

Table 12

| | Example 7 | Example 8 |
|---|---|---|
| Conversion of $C_4H_{10}$ (%) | 78.1 | 74.2 |
| Temperature (° C) | | |
| Upon initiation of reaction 295 | 295 | |
| 50 hours thereafter | 297 | 300 |

Table 12-continued

| | Example 7 | Example 8 |
|---|---|---|
| 500 hours thereafter | 300 | 308 |

What we claim is:

1. A process for producing fuel gas containing as a main component methane in combination with ethane and having a calorific value of more than 9,500 Kcal/Nm³ which comprises contacting a hydrocarbon having at least 3 carbon atoms and a boiling point of not more than 150° C with hydrogen in gaseous phase in the presence of a catalyst at a temperature of 150° to 400° C, said catalyst comprising 10 to 70 weight percent molybdenum oxide and 3 to 15 weight percent nickel oxide respectively supported on γ-alumina carrier said percents being based on the weight of the carrier, and the proportion of said nickel oxide being in the range of 9 to 60 weight percent, based on the weight of the molybdenum oxide.

2. The process according to claim 1, in which said hydrocarbon is at least one of saturated aliphatic hydrocarbons, saturated alicyclic hydrocarbons and aromatic hydrocarbons.

3. The process according to claim 2, in which said hydrocarbon is at least one of saturated aliphatic hydrocarbons having 3 to 9 carbon atoms.

4. The process according to claim 1, in which the amount of the molybdenum oxide supported on the solid carrier is in the range of 14 to 32 weight percent, based on the weight of the solid carrier.

5. The process according to claim 1, in which the amount of nickel oxide, supported on the solid carrier is in the range of 4 to 10 weight percent, based on the weight of the solid carrier.

6. The process according to claim 1, in which said hydrogen is used in an amount between 3.5:1 and 4.0:1 in terms of atomic ratio of hydrogen to carbon contained in the starting mixture of the hydrogen and the hydrocarbon.

7. The process according to claim 6, in which said atomic ratio of hydrogen to carbon is in the range between 3.5:1 and 3.7:1.

8. The process according to claim 1, in which said hydrocracking is conducted at a temperature of 200° to 350° C.

9. The process according to claim 1, in which said proportion of nickel oxide to molybdenum oxide is in the range of 15 to 30 weight percent.

* * * * *